United States Patent [19]

Pauls et al.

[11] 4,241,853

[45] Dec. 30, 1980

[54] DISPENSER FOR EITHER CONTINUOUS OR INTERMITTENT DISCHARGE

[75] Inventors: James D. Pauls; Roy Hammett, both of Miami; William S. Blake, Miami Lakes, all of Fla.

[73] Assignee: James D. Pauls and J. Claybrook Lewis and Associates, Limited, Miami, Fla.

[21] Appl. No.: 906,747

[22] Filed: May 17, 1978

[51] Int. Cl.[2] ..... B05B 11/02

[52] U.S. Cl. ..... 222/207; 222/335; 222/340; 222/383; 222/402.14

[58] Field of Search ..... 222/153, 207, 209, 257, 222/321, 335, 340, 341, 380, 382, 383, 384, 385, 396, 397, 402.14; 239/323, 333, 526; 417/328, 544

[56] References Cited

U.S. PATENT DOCUMENTS

| | | | |
|---|---|---|---|
| 2,545,319 | 3/1951 | Sundholm | 222/383 X |
| 3,348,740 | 10/1967 | O'Donnell | 222/153 |
| 3,452,905 | 7/1969 | Micallef | 222/321 X |
| 3,749,290 | 7/1973 | Micallef | 222/207 X |
| 3,777,945 | 12/1973 | Nozawa et al. | 222/340 X |
| 3,797,749 | 3/1974 | Tada | 222/383 X |
| 3,921,861 | 11/1975 | Kondo | 222/257 |
| 3,927,834 | 12/1975 | Tada | 239/526 X |
| 4,033,487 | 7/1977 | Micallef | 222/207 |
| 4,109,832 | 8/1978 | Kutik et al. | 222/321 X |
| 4,155,487 | 5/1979 | Blake | 222/207 |
| 4,167,941 | 9/1979 | Capra et al. | 222/321 X |

FOREIGN PATENT DOCUMENTS

| | | | |
|---|---|---|---|
| 2744654 | 4/1978 | Fed. Rep. of Germany | 239/526 |

*Primary Examiner*—David A. Scherbel
*Assistant Examiner*—Fred A. Silverberg
*Attorney, Agent, or Firm*—Dennis H. Lambert

[57] ABSTRACT

A multi-function dispenser may be adjusted to obtain a spray or stream of the material dispensed, either as a long duration discharge of the material or as intermittent discharges corresponding to actuation of a trigger actuator, or as a continuous discharge during actuations of the trigger, depending upon functional design variables. Structure is provided for storing an accumulated amount of material upon repeated operations of the trigger, for subsequent prolonged discharge of the material, or the accumulating structure may be bypassed for intermittent discharges of the material as the trigger is operated, or the accumulating structure may function as a holding chamber whereby a continuous discharge of the material may be obtained while the trigger is being operated.

20 Claims, 21 Drawing Figures

FIG. 1.
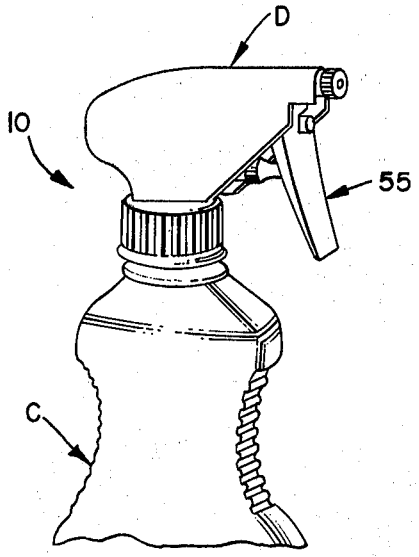
FIG. 3.
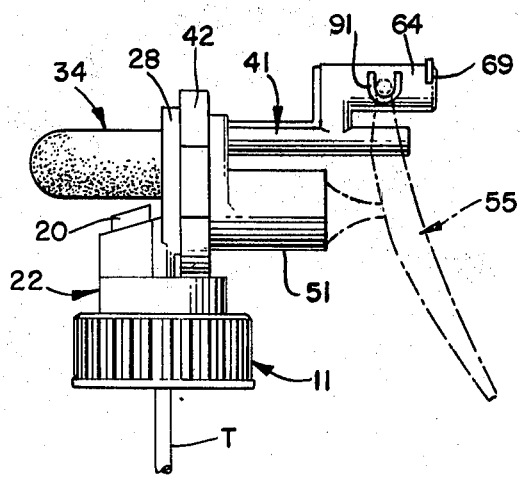
FIG. 2.
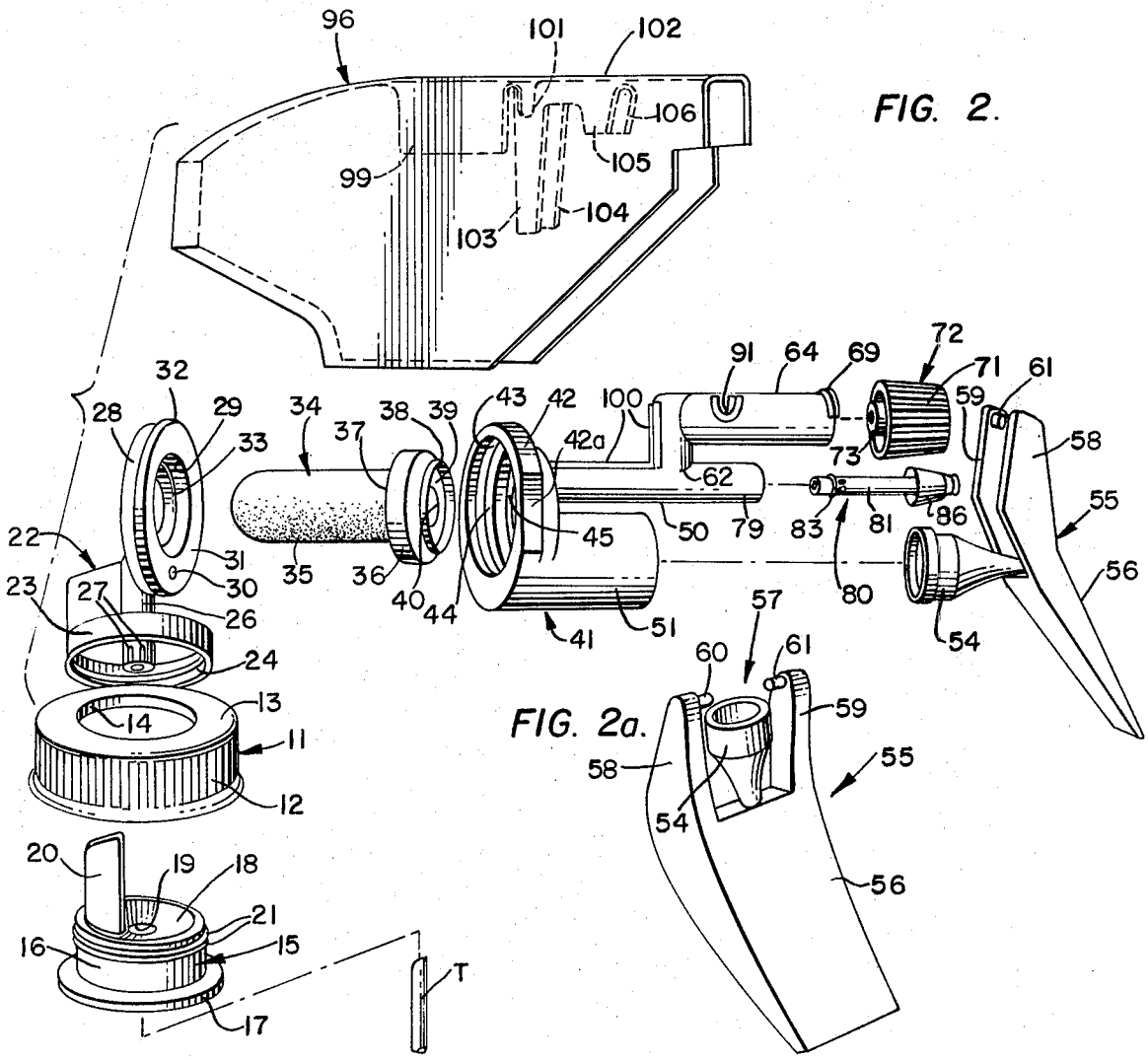
FIG. 2a.

DISPENSER FOR EITHER CONTINUOUS OR INTERMITTENT DISCHARGE

BACKGROUND OF THE INVENTION

This invention relates to dispensers, and more particularly, to dispensers for discharging material under pressure.

In the prior art, basically three different types of dispensers for discharging material are provided. These include: aerosol devices utilizing chemical propellants to pressurize and discharge the material; trigger operated mechanical discharge means wherein a pivoted trigger or lever is connected with a piston or plunger to obtain intermittent discharge or squirts of material; and finger operated pumps wherein a plunger is depressed with the finger to obtain intermittent discharges or squirts of the material.

All of these devices have one or more more disadvantages. For example, aerosol devices utilizing chemical propellants are being banned because of their potential harm to the environment. Moreover, these devices require specially constructed containers built to withstand high internal pressure, and the chemical propellants are not compatible with many materials desired to be dispensed. Additionally, there is considerable danger in handling and disposing of aerosol devices utilizing chemical propellants because of the pressures and explosive materials involved, and special precautions must be observed when filling aerosol containers utilizing chemical propellants.

The trigger operated dispensers and finger operated pump dispensers both eliminate the dangers inherent with chemical propellants, but are relatively difficult to operate and only a single short burst or discharge of the material is obtained with each manipulation of the actuator. The action required to operate such devices, and particularly the pump or plunger type devices, results in spray inaccuracy and finger fatigue.

SUMMARY OF THE INVENTION

The present invention represents a significant improvement over the prior art devices described above and is a specific improvement over the invention disclosed in Ser. No. 889,904, filed Mar. 24, 1978, which is, in turn, a divisional application of Ser. No. 729,830, filed Oct. 5, 1976, now Pat. No. 4,167,941.

More particularly, the present invention relates to a mechanically operated dispensing device which does not rely upon chemical propellants to obtain a pressurized discharge of the material and wherein the device may be easily operated with only one hand. Moreover, the device of the invention has several different modes of operation, including: a continuous and substantially constant discharge of material after an initial accumulating or charging operation, and requiring minimal force to operate a discharge member or button for release of material pressurized during the accumulating or charging operation; a continuous spray or discharge of the material during the time a pressurizing or charging member is being operated; and intermittent spurts or discharges of material coinciding with operation of a charging or pressurizing member.

Even more specifically, the present invention relates to a trigger operated dispensing device wherein a pivoted trigger is connected with a first expansible chamber means or pressurizing chamber for drawing material from a container and pressurizing it for discharge under pressure. A second expansible chamber means or accumulating chamber is connected with the first expansible chamber means for receiving pressurized material therefrom and accumulating a quantity of the material for subsequent discharge under pressure. A discharge valve includes flow control means connected between the expansible chambers and a discharge nozzle for operation between a plurality of positions, including a first position for precluding flow from either of the expansible chambers to the nozzle, and a second position establishing fluid communication between the expansible chambers and the nozzle. When the valve is in its first position, the trigger may be operated to draw material from the container, pressurize it and charge it into the accumulating chamber for storage of a quantity of the material under pressure in the accumulating chamber. Subsequent operation of the valve means to its open position releases the accumulated pressurized material from the accumulating chamber through the nozzle.

Alternatively, the valve means may be left in an open position and the trigger operated, whereupon the material will be drawn from the container to the first expansible chamber means, under pressure, and thence discharged in a substantially continuous flow through the valve means and nozzle.

If the first operation of the dispenser of the invention is accomplished with the valve in the open position, the material will be drawn into the first expansible chamber, pressurized therein and discharged through the nozzle in intermittent bursts or spurts, concomitant with operation of the trigger. On the other hand, if the first operation of the dispenser of the invention is accomplished with the valve in the closed position, operation of the trigger will cause material to be drawn from the container into the first expansible chamber, pressurized therein and discharged into the second expansible chamber means for accumulation of the material therein by repeated operations of the trigger. Subsequently, when the valve is opened, the accumulated, pressurized material in the second expansible chamber means will be discharged through the nozzle with a continuous, long duration, relatively constant pressure spray or stream, as desired, Thereafter, if the valve is left in the open position and the trigger operated, material will be drawn from the container into the first expansible chamber means, pressurized therein and discharged through the nozzle. However, a portion of the material will enter the second expansible chamber means and accumulate therein under pressure, whereby when the trigger is released for return of the first expansible chamber means to draw an additional charge of material thereinto, the previously accumulated material in the second expansible chamber means will be discharged through the nozzle, such that a substantially continuous discharge of material is obtained during operation of the trigger, the aforesaid being accomplished by means of controlling functional variables.

Moreover, the trigger operated dispenser of the present invention is exceptionally simple and economical in construction and is rugged and durable in operation. Further, when operating in the duration mode, the dispenser may be operated in any position, even upside down, without affecting the performance thereof. Additionally, the dispenser of the invention is refillable, if desired, and accomplishes performance goals currently achieved only with propellant based aerosols in explosion-proof cans. The present invention also allows optimum product formulation rather than requiring compromise due to chemical incompatibility between the product to be dispensed and a chemical propellant.

Still further, the present invention may be used to dispense a wide variety of products. Additionally, the dispenser includes means which permits unused pressurized product to leak back into the container, thereby providing a child safety feature. Means is also provided for relieving excess pressure, thereby preventing overpressurization of the second expansible chamber means.

Even further, a unique, unitary, integrally molded piston-trigger unit is provided in accordance with the invention, which is more economical and is easier to assemble than prior art devices; and a unique, integrally molded trigger return spring is provided in the shroud of the dispenser of the invention.

OBJECTS OF THE INVENTION

It is an object of this invention to provide a means for discharging material under pressure, without using chemical propellants and wherein the means is selectively operable to obtain either a duration discharge or an intermittent discharge of the material.

Another object of the invention is to provide a mechanically operated means for obtaining a long duration discharge of material, and wherein the means may be easily operated with only one hand.

A further object of the invention is to provide a mechanically operated means for discharging material under pressure wherein the means may be operated with one hand, and is selectively operable to obtain either a duration discharge or an intermittent discharge of the material, and wherein the means is exceptionally simple and economical in construction and is rugged and durable in use.

A still further object of the invention is to provide a trigger operated dispensing device for discharging material under pressure, wherein the device includes means for obtaining either a substantially constant pressure, long duration spray or discharge of the material, or an intermittent discharge of the material as desired.

A still further object of the invention is to provide a dispensing device which is capable of operating in three different modes for obtaining either a long duration constant discharge of material, or continuous discharge of material during operation of the pressurizing means, or intermittent discharge of the material concomitant with operation of the pressurizing means.

A more specific object of the invention is to provide a trigger operated spray dispenser which includes a first expansible chamber means connected with a pivoted trigger whereby operation of the trigger alternately draws material from a container into the first expansible chamber means and then pressurizes the material and transfers it under pressure to a second expansible chamber means for accumulation under pressure of the material, and a valve means is connected with the second expansible chamber means for releasing the pressurized material therefrom, as desired.

Another object of the invention is to provide a mechanically operated dispensing device for obtaining pressurized discharge of material, wherein a valve member is provided and has an off position precluding flow from the device and an on position enabling flow in either of two different modes.

A further object of the invention is to provide a trigger operated spray dispenser which has an accumulating chamber therein for accumulating a quantity of material under pressure and wherein a leak-back passage is provided for leaking unused material from the accumulating chamber to thereby provide a child safety feature.

Yet another object of the invention is to provide a means for discharging material under pressure wherein an accumulating chamber is provided for accumulating a quantity of material under pressure for subsequent discharge, and overpressure relief means is provided in communication with the accumulating chamber means for relieving excess pressure from the accumulating chamber means.

An even further object of the invention is to provide a trigger operated spray dispenser which is capable of obtaining a duration spray and which may be attached to conventional containers.

Yet a further object of the invention is to provide a trigger operated spray dispenser which may be attached to conventional containers and which may be assembled on conventional filling and capping lines and yet which includes means for obtaining a duration spray.

A further object of the invention is to provide a unique, integrally molded piston and trigger unit, which is economical and easy to assemble.

A still further object of the invention is to provide a unitary piston and trigger unit, integrally molded from high density polyethylene, and thus facilitate assembly of the unit to the dispenser manifold.

An even further object of the invention is to provide a unique, unitary, integrally molded shroud and trigger return spring unit, which eliminates the need for a separate trigger return spring, thus making the device of the invention more economical than some prior art devices, and facilitating assembly thereof.

Yet another object of the invention is to provide a positive acting vent for the container, which is opened to vent the container whenever the accumulating chamber means is expanded for discharge of material.

BRIEF DESCRIPTION OF THE DRAWINGS

FIG. 1 is a perspective view of a container having a trigger operated dispenser of the invention assembled thereto.

FIG. 2 is an exploded perspective view of the dispenser of the invention.

FIG. 2*a* is a perspective view of the unitary, integrally molded piston and trigger unit of the invention, showing the piston in the as-molded orientation.

FIG. 3 is a view in side elevation of the dispenser of the invention showing the parts of FIG. 2 assembled together, except for the piston/trigger, discharge valve means, shroud and nozzle, which are removed from this figure for the purposes of clarity.

DETAILED DESCRIPTION OF THE INVENTION

Figure 4:
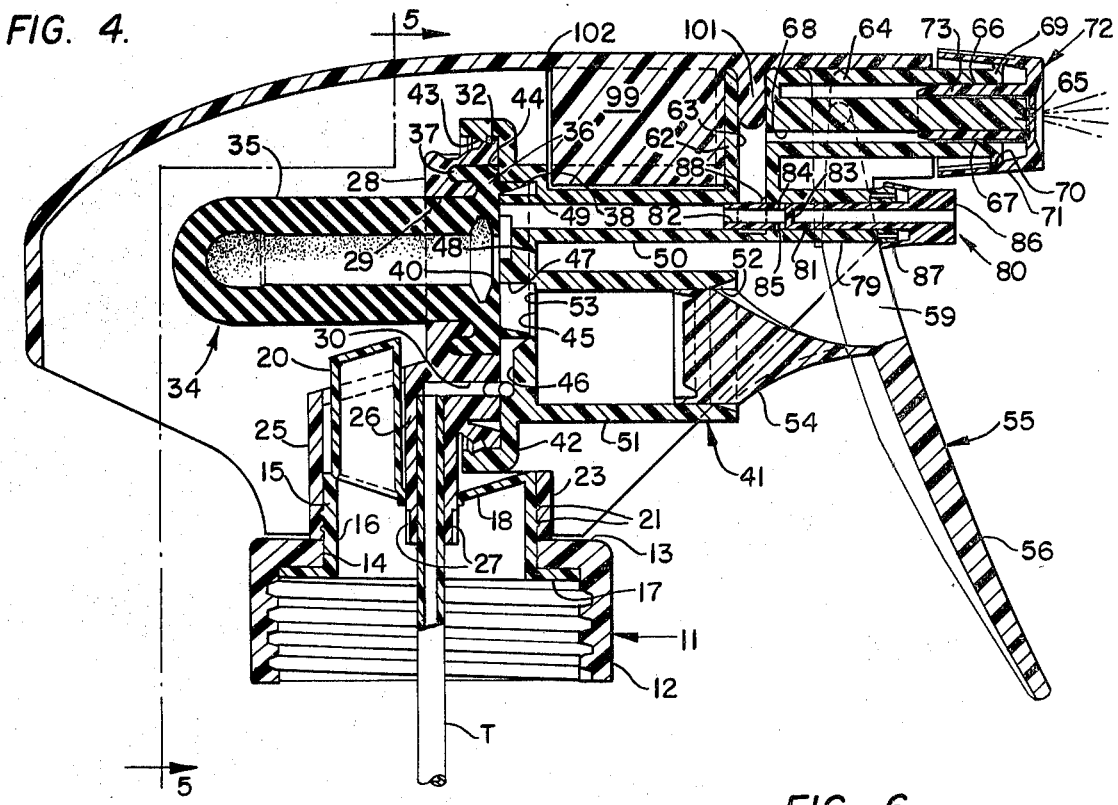
FIG. 4 is an enlarged, longitudinal vertical sectional view of the dispenser of the invention.
Figure 5:
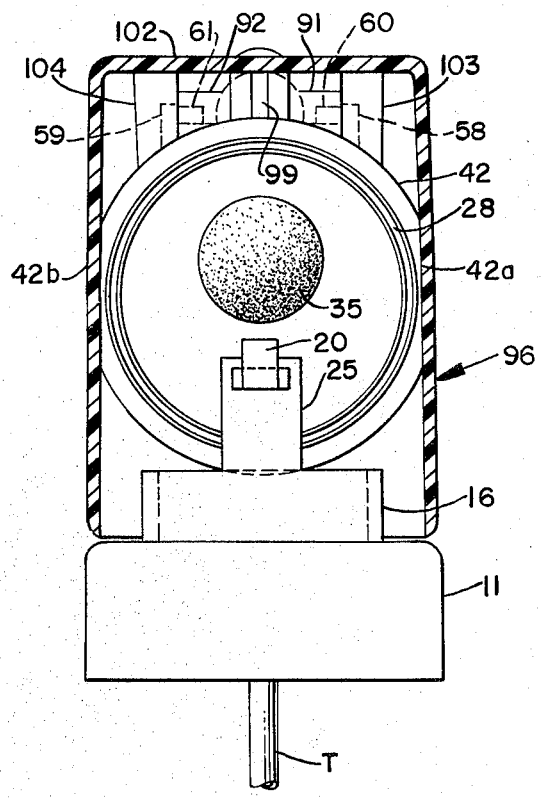
FIG. 5 is a view in section taken along line 5—5 in FIG. 4.
Figure 6:
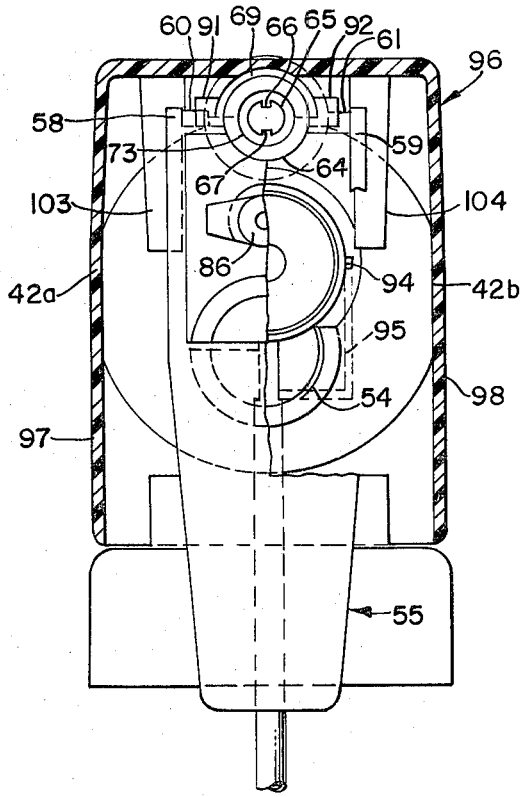
FIG. 6 is a front elevational view of the device of FIG. 4 with portions broken away, and the shroud in section.
Figure 7:
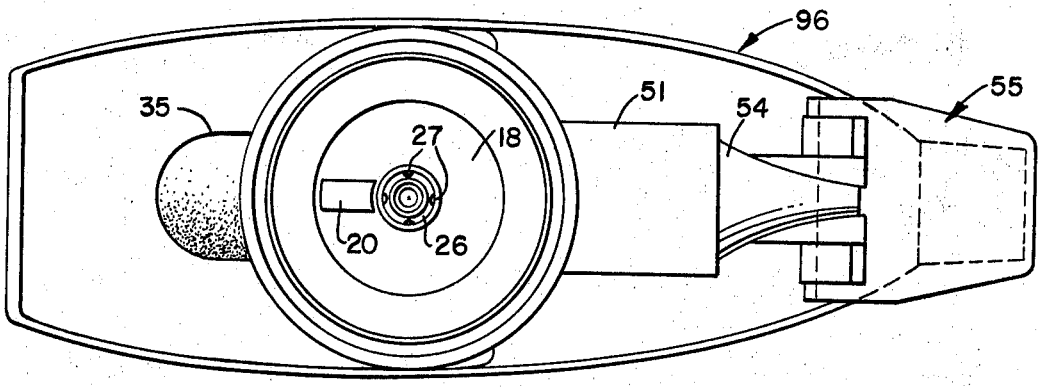
FIG. 7 is a bottom view of the dispenser of FIG. 4.

In the drawings, wherein like reference numerals indicate like parts throughout the several views, a container C having a trigger operated dispensing device D thereon in accordance with the invention is represented generally at 10 in FIG. 1. The container C may be made of any suitable material such as metal, glass or plastic amd may be produced in any desired configuration or design for functional or aesthetic reasons.

The components of the dispensing device D are seen best in FIGS. 2 through 7 and comprise a closure member 11, which in one form of the invention comprises a cylindrical, internally threaded skirt 12 having a top wall 13 with a central opening 14 formed therethrough. A vent adapter 15 has a cylindrical side wall 16 extended through the opening 14 in the closure 11 and an outwardly directed annular flange 17 on the lower end thereof engaged beneath the end wall 13 of the closure 11. The vent adapter 15 has a concave, substantially frustoconically shaped end wall 18 with a central opening 19 therethrough and an upstanding post or vent actuator 20 integrally formed thereon. A plurality of outwardly formed rings or ribs 21 are on the outer surface of the cylindrical body 16 of the vent adapter 15 for a purpose described below.

A one-piece molded bladder retainer 22 includes a depending cylindrical skirt 23 having a plurality of ribs or channels 24 formed on the inner surface thereof for secure snap-fitting engagement with the ribs 21 on the vent adapter 15, as seen in FIG. 4. Thus, when the vent adapter, bladder retainer and closure are assembled together, as in FIG. 4, they are securely held in the assembled relationship by engagement of the outwardly turned flange 17 of the vent adapter beneath the wall 13 of closure 11 and the engagement of cylindrical wall 23 of bladder retainer 22 against the top of wall 13. A generally rectangularly shaped upstanding configuration 25 is formed on the top of cylindrical skirt 23 at one side thereof, and defines a rectangularly shaped channel therein in which the upstanding post 20 is slidably received when the parts are in assembled relationship. The configuration 25 thus defines a guide or support member for the vent actuator 20 and the guide or support member extends substantially from the outer circumference of skirt 23 to the center thereof. An elongate, axially extending tubular member 26 is formed at the center of the bladder retainer coaxially with the axis of skirt 23, and a plurality of axially extending flutes or channels 27 are formed in the outer surface thereof at the lower end for cooperation with the opening 19 through the frustoconical wall 18 of the vent. Thus, with the parts in their normal assembled position, as seen in FIG. 4, the flutes or channels 27 terminate short of the point of engagement of wall 18 with the outer surface of tubular member 26, whereby the opening 19 through the wall 18 is closed. However, when the wall 18 is moved downwardly, the opening 19 comes into registry with the flutes or channels 27 thereby establishing communication from above the wall to below the wall.

An upstanding, substantially circular superstructure 28 is formed at the upper end of the tubular member 26 and has an opening 29 formed therethrough with its axis extending perpendicularly to the axis of the skirt 23. A second, smaller opening 30 is also formed through the circular superstructure 28 and extends from the front face 31 thereof rearwardly into registry with the upper end of the bore through tubular member 26. A radially outwardly projecting locking rib 32 is formed on the outer periphery of the superstructure 28 and an axially forwardly projecting annular wall or retaining flange 33 is formed on the inner surface of the superstructure 28 in surrounding relation to opening 29.

An expansible chamber means or accumulating chamber 34 comprises a resilient bladder 35 having an elongate hollow body with a radially outwardly projecting flange 36 on one end thereof, having an annular rearwardly directed wall or retaining lip 37 received in the cavity formed behind retaining lip or flange 33 of the bladder retainer 22. The bladder 35 also has a relatively thin, flexible, forwardly projecting, cylindrical valving wall 38 formed on the forward wall surface thereof, and an annular, radially inwardly directed, flexible valving ring or member 39 is formed substantially coplanar with the forward end wall surface of the bladder and defines a central opening 40 opening into the hollow interior of the bladder.

A one-piece molded manifold member or body 41 includes a cylindrical wall 42 having a detent rib or ring 43 formed on the inner surface thereof and which cooperate with the locking rib 32 on the bladder retainer 22 to hold the manifold 41 to the bladder retainer as seen in FIG. 4. An annular, rearwardly facing wall 44 is formed in the manifold, radially inwardly of the skirt or wall 42, and the annular wall 44 engages an outer marginal edge portion of the flange 36 on bladder 35 to securely hold the bladder in position between the bladder retainer and manifold. The end wall 44 is countersunk at 45, defining a recess or chamber in which the cylindrical valving wall 38 of the bladder is received. The diameter of the chamber 45 is approximately the same as the outer diameter of the wall 38, whereby the wall 38 engages snugly against the wall of chamber 45, and cooperates therewith to form a valve preventing flow from the bladder into a radially extending port or passage 46 formed in the manifold 41 and which communicates at its radially outer end with the forward end of passage 30 in bladder retainer 22. The central portion of the manifold 411 projects rearwardly at 47 into engagement with the annular valving member 39 on the bladder whereby flow from the hollow interior of the bladder into the chamber 45 is prevented by seating of the valving member 39 against the projection 47 of the manifold. A chamber 48 is formed at one side of the bladder in communiction with the central opening 40 for free flow of material from within the bladder, through the chamber 48 and into elongate passage or port 49 extending forwardly through a tubular discharge portion 50 of the manifold.

The manifold 41 also includes a cylindrical wall 51 projecting forwardly from the cylindrical wall 42 at substantially one diametral half portion thereof, and having an open forward end 52, and an opening 53 through the rearward end opening into the chamber 45.

A novel piston-trigger combination includes a piston 54 reciprocable in the cylinder 51 and defining with the cylinder, and expansible chamber means or charging chamber, which is operable when the piston is moved forwardly in cylinder 51 to draw material from a container C upwardly through dip tube T and through passage 30 into passage 46, urging the annular cylindrical valving wall 38 to an open position from the end of passage 46, and into the cylinder 51. When the piston 54 is moved rearwardly in the cylinder, the material therein is pressurized and caused to flow through the opening 53 and against valving member 39, moving it away from the projection 47, and thence into the bladder 35 and also through chamber 48 and into passage 49.

The piston 54 is formed integrally with a trigger-type actuator 55 having a generally flat lower end 56 and a bifurcated upper end 57 defining a pair of spaced apart legs 58 and 59 having inturned pivot pins or stub shafts 60 and 61 at their upper ends, respectively. The piston 54 and trigger 55 are preferably molded from a high density polyethylene, which enables assembly of the piston-trigger to the manifold, and ensures long life of the unit, and does not require initial flexing of the piston relative to the trigger when the molded assembly is first removed from the mold, as do prior art structures molded from polypropylene wherein it is necessary to flex the unit immediately upon its removal from the mold and while still warm in order to obtain appropriate molecular orientation such as to define a hinge. Thus, the steps of assembling the unit of the invention are more simple and economical than with the prior art devices, and to applicant's knowledge, the present invention is the only unitary, integrally molded piston-trigger unit. Moreover, while only one piston is shown, more than one piston could be connected with the trigger, if desired, for cooperation with a corresponding number of cylinders in order to obtain desired or required displacement volume in the device, while maintaining satisfactory force requirements.

The manifold 41 further includes an upstanding tubular post member 62 having a discharge passage 63 extending axially therethrough and opening through the upper end thereof, and terminating at its lower end in communication with the forward end of passage 49 in tubular discharge member 50.

A forwardly extending nozzle tube 64 is formed at the upper end of the post 62 and projects in a direction parallel with the tubular discharge member 50. The nozzle tube 64 has a coaxially extending nozzle spud 65 formed therein and projecting axially outwardly beyond the end of the nozzle tube. The spud 65 is spaced inwardly from the inner wall surface of nozzle tube 64 and has a pair of longitudinally extending feed grooves or channels 66 and 67 therein. A port 68 extends from the annular chamber defined between spud 65 and tube 64 and communicates with passage 63 in post 62. A radially outwardly projecting flange or rib 69 is formed on the outer end of nozzle tube 64 and locks behind a cooperating rib 70 formed in the inner surface of the skirt 71 of nozzle 72. A tubular sleeve 73 is formed within the nozzle 72 and projects rearwardly into the annular chamber defined between the spud and nozzle tube and seals the annular chamber against flow outwardly past the nozzle, except for flow through the feed grooves or channels 66 and 67 to the nozle opening.

Figure 10:
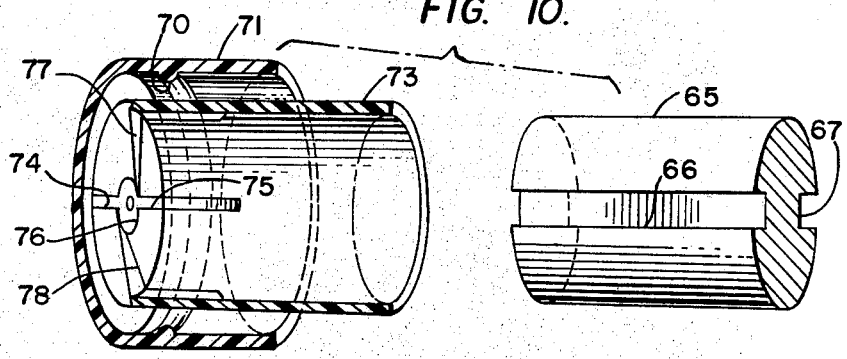
FIG. 10 is an exploded perspective view, with parts shown in section, of the nozzle and spud used in the device of the invention.
Figure 8:
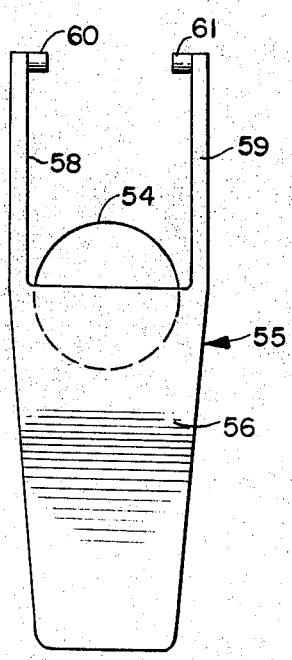
FIG. 8 is an enlarged front view in elevation of the trigger/piston of the device of the invention.
Figure 9:
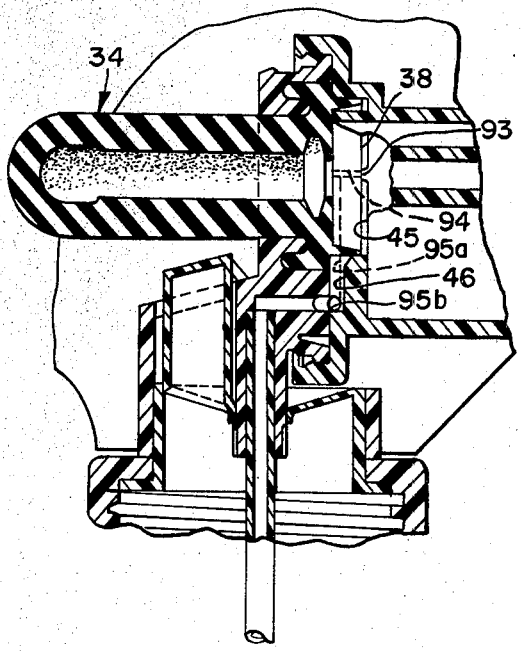
FIG. 9 is an enlarged, fragmentary view in section, with portions removed, showing the leak-back and overpressure relief channel.
Figure 9A:
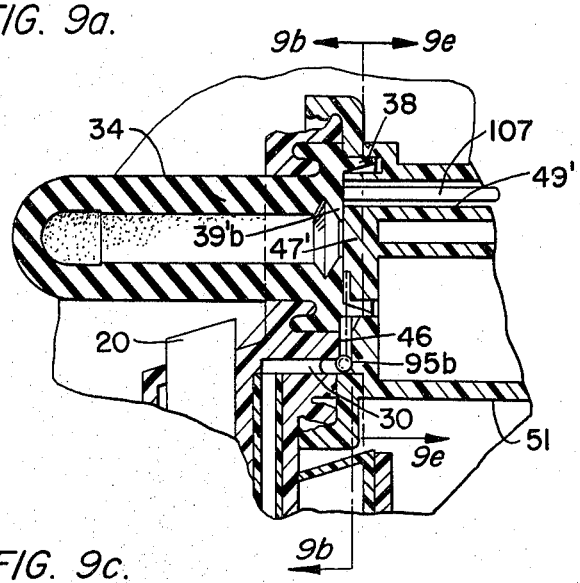
FIG. 9*a* is a fragmentary view in section of the blow-by and leak-back features of the invention of FIG. 9.
Figure 9B:
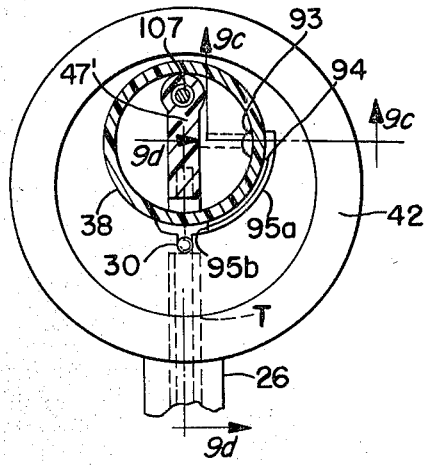
FIG. 9*b* is a view in section taken along line 9*b*—9*b* in FIG. 9*a*.
Figure 9C:
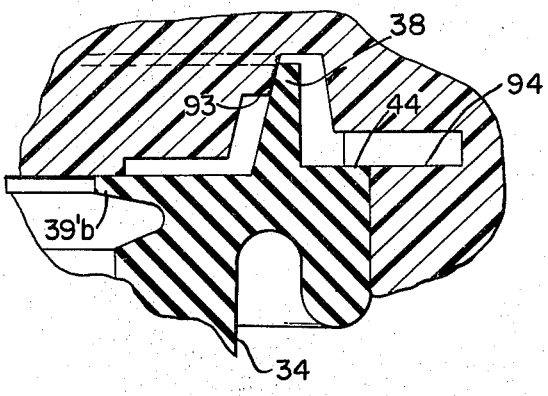
FIG. 9*c* is a view in section taken along line 9*c*—9*c* in FIG. 9*b*.
Figure 9D:
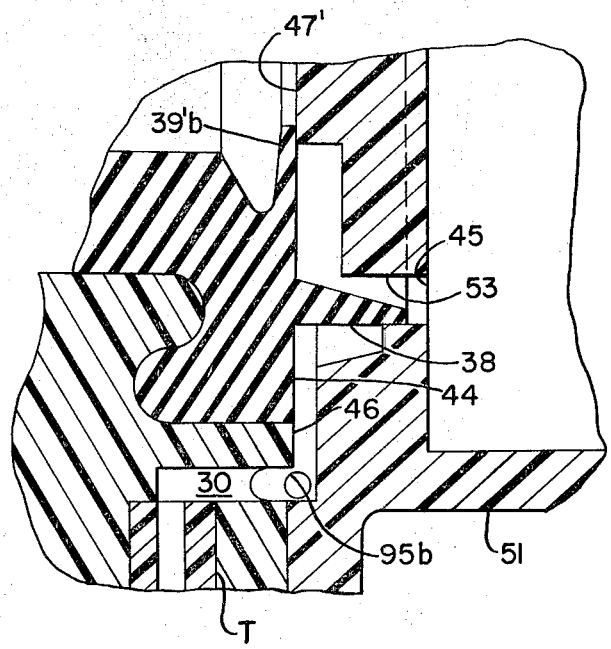
FIG. 9*d* is a view in section taken along line 9*d*—9*d* in FIG. 9*b*.
Figure 9E:
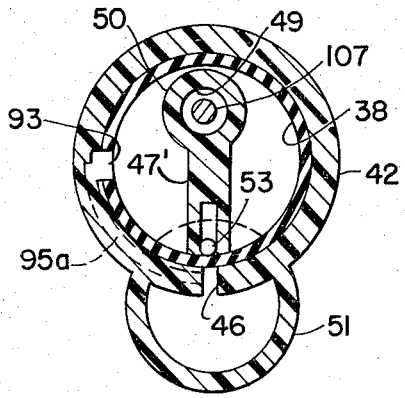
FIG. 9*e* is a view in section taken along line 9*e*—9*e* in FIG. 9*a*.
Figure 11:
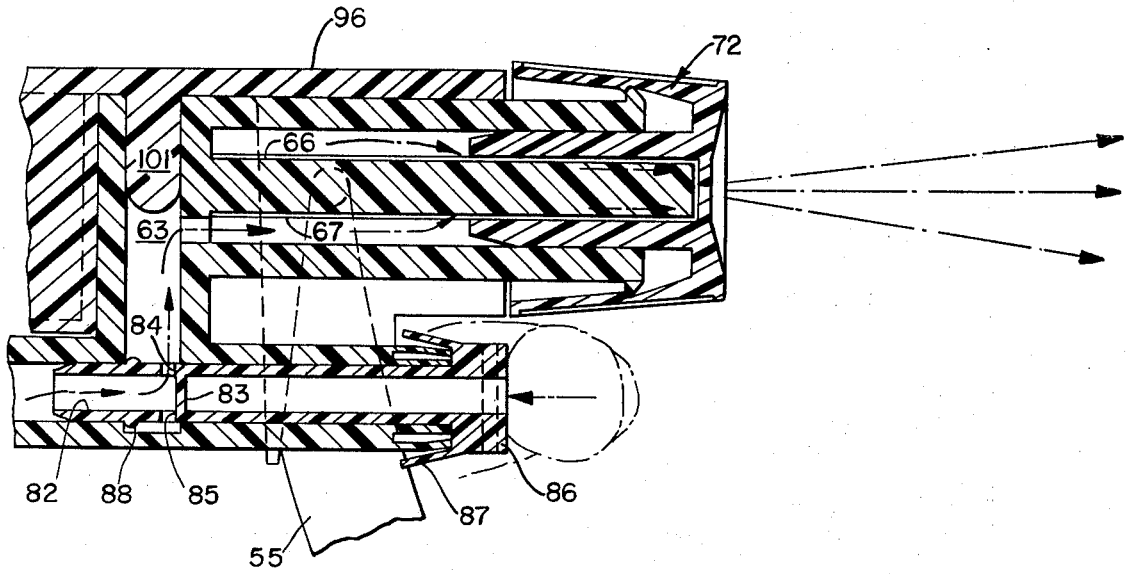
FIG. 11 is an enlarged, fragmentary sectional view of the discharge valve showing the valve in its depressed or open position for obtaining discharge of material.

As seen best in FIG. 10, a pair of diametrically opposed channels or slots 74 and 75 are formed on the inner face of the nozzle end wall and communicate at their inner ends with a relatively small circular swirl chamber 76. A second pair of substantially radially extending, diametrically opposed channels or slots 77 and 78 are also formed in the nozzle end wall and extend substantially perpendicular to the axis of the slots 74 and 75. The slots 77 and 78 communicate tangentially at their inner ends with the swirl chamber 76. The bead or rib 70 formed on the inner surface of the nozzle skirt 71 includes a pair of detents spaced 180° apart for cooperation with the flange or rib 69 on the nozzle tube 64 whereby the nozzle 72 may be turned or rotated to either of two positions disposed 180° apart, and whereat either the pair of slots 74 and 75 will be aligned with the feed grooves 66 and 67, or the slots 77 and 78 will be aligned with the feed grooves or slots 66 and 67. If the slots 74 and 75 are aligned with the feed grooves, a stream of fluid is emitted from the nozzle, whereas if the slots 77 and 78 are aligned with the feed grooves 66 and 67, a spray of fluid is emitted from the nozzle.

The discharge tube 50 projects at 79 beyond the post 62, and the bore 49 in the discharge tube extends outwardly through the extended end portion 79 and opens outwardly through the outer end thereof. A discharge valve 80 is received in the passage 49 in the extended end portion 79 and includes a tubular valving shaft 81 snugly received in the passage 49 and having a passage 82 formed therein at the inner end thereof communicating in axially aligned relationship with the passage 49 and terminating at its inner end in a wall 83. A plurality of radially extending ports 84 and 85 are formed through the wall of the shaft 81 at the inner end of the passage 82, and a head member 86 is formed on the outer end of the shaft outwardly of the extended end portion 79 of discharge tube 50. The head member or button 86 has a flexible annular skirt 87 thereon which engages against the outer end portion of the extended end 79 and serves to resiliently urge the discharge valve 80 outwardly of the extended end 79, or to the right as viewed in FIG. 4. A circumferentially extending annular seal and stop 88 is formed on the outer surface of the shaft 81 between the open inner end thereof and the radial ports 84 and 85, and when the discharge valve is urged outwardly by the skirt 87, and the annular seal and stop 88 engages against an adjacent wall surface of the passage 63 in post 62 to prevent further outward movement thereof. In this position the ports 84 and 85 are sealingly closed to flow therethrough and no material can flow through the passage 63 to the nozzle. However, the head or button 86 may be engaged with the finger and pressed inwardly of the extended end portion 79 against the flexing, resilient action of the skirt 87 to align the radial ports 84 and 85 with the vertical passage 63 in post 62, whereupon any pressurized fluid in passage 49 will escape through passage 82 and ports 84 and 85, and thence upwardly through vertical passage 63 and through port 68 to the annular chamber between the nozzle spud 65 and nozzle tube 64 and thence through the feed grooves or slots 66 and 67 to one or the other of the pairs of radially extending slots or channels in the nozzle end wall.

Figure 12:
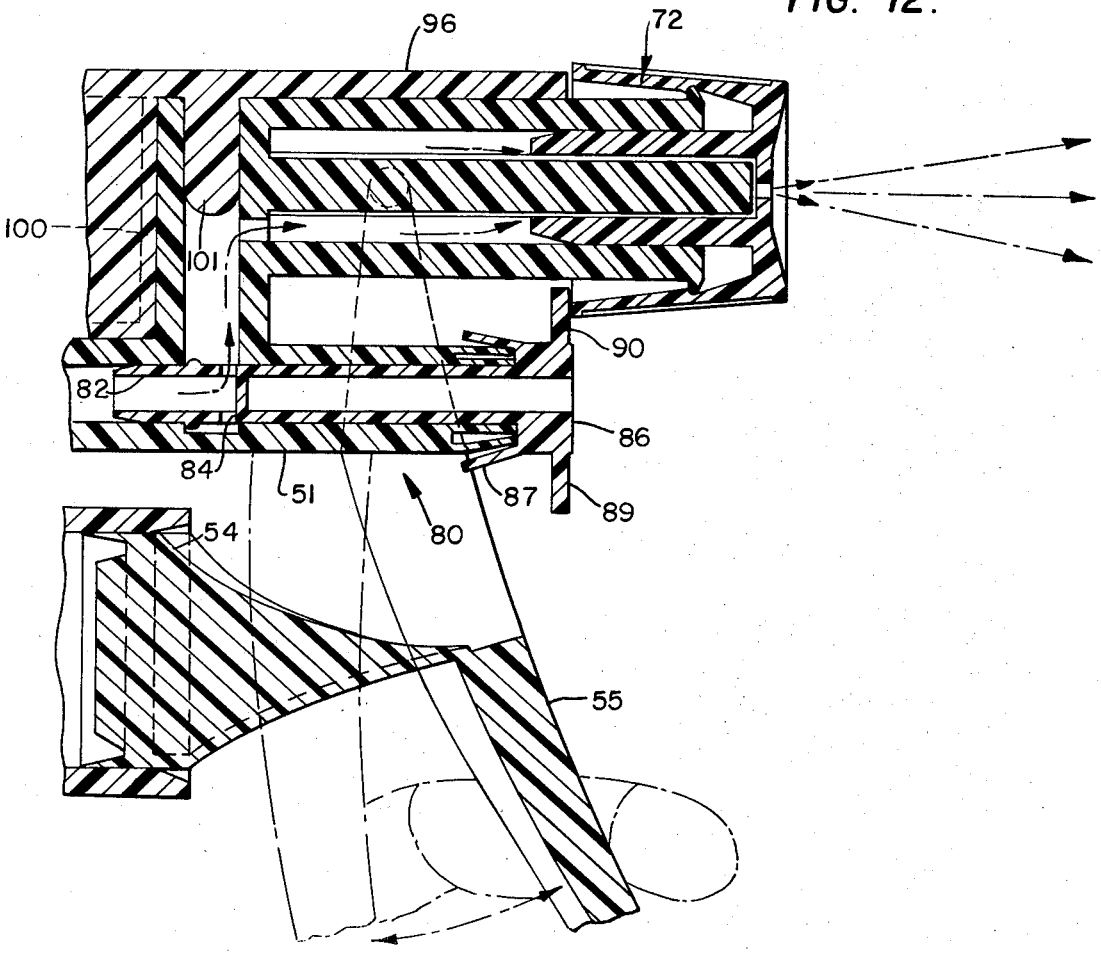
FIG. 12 is a view similar to FIG. 11 but with the discharge valve rotated 90° about its longitudinal axis to lock the valve in its depressed or open position for continuous discharge of material from the device.

A pair of radially outwardly projecting latching means or tabs 89 and 90 are formed on the head or button 86 whereby the button may be moved inwardly to open the discharge valve 80 and rotated 90° in either direction to bring one or the other of the latching tabs 89 and 90 into registry behind the skirt 71 of nozzle 72, thereby latching the button and discharge valve in the inwardly depressed, open position. See FIG. 12.

A pair of stirrups or U-shaped pivot supports 91 and 92 are formed on opposite sides of the nozzle tube 64, and the inwardly projecting pivot pins or tabs 60 and 61 on the trigger are received therein.

A safety feature is provided in association with the bladder 35 for relieving or returning to the container excess pressure which might be developed by excessive operation of the trigger without an intervening discharge of material. Additionally, a slow leak-back is provided whereby the dispensing device of the invention is not capable of being left with an undischarged pressurized supply of material in the bladder for any extended period of time. This safety feature is seen best in FIGS. 4, 6, 9 and 9*a*–9*e*, and as seen in these figures, the flexible, cylindrical valving skirt or wall 38 terminates short of the end surfaces of the chamber 45 in which it is received, and a relatively short, rearwardly projecting tab 93 is integrally formed in the chamber at the end wall thereof and projects rearwardly into contiguous relationship with the forward edge of the valving skirt or wall 38. A channel or roughened surface configuration or the like may be provided to enable the slow leak-back to be accomplished. An axially extending blow-by passage or port 94 is formed in the side wall of chamber 45 and extends rearwardly from tab 93 to the surface or shoulder 44 in the bladder retainer and thence downwardly at 95*a* and laterally at 95*b* into registry with the port 46. In normal usage, the valving skirt or wall 38 does not effect a perfectly fluid-tight seal relative to the surface of the chamber 45, and particularly at the location of the tab 93. Accordingly, if the bladder 35 is inflated or filled with material to be dispensed and the discharge valve is not opened to dispense or discharge the material from the bladder, the material will nonetheless slowly leak back through the ports or passages 94 and 95 to passage 46 and from there back into the container. Similarly, if excessive pressure is generated within the bladder 35 by overfilling it, the flexible valving skirt or wall 38 will flex away from the tab 93, opening relatively free communication with passage 94, thereby dumping or by-passing the excessive pressure back into the container.

A one-piece, molded shroud 96 is disposed in covering relationship to the dispenser assembly and includes a pair of spaced apart opposite side walls 97 and 98, extending downwardly closely on opposite sides of the manifold 41. If desired, the opposite side portions of the manifold at 42*a* and 42*b* may be flattened to engage the inner surface of the sides 97 and 98 of the shroud relative to the manifold. Additionally, a downwardly projecting, rectangularly shaped web or plate 99 is engaged at its bottom and end edges in a complemental channel 100 formed on the top of the discharge tube member 50 and the rear surface of the post 62, respectively. A pin 101 projects downwardly from the underside of the top wall 102 of the shroud and is engaged in the upper end of passage 63 in the post 62 closing the passage and also accurately aligning the shroud relative to the manifold and assisting in retaining the parts in assembled relationship. A pair of integrally molded, downwardly projecting, spaced aparts leaf spring members 103 and 104 depend from the top wall 102 of the shroud into aligned registry with the legs 58 and 59 of the trigger 55, and normally urge the trigger forwardly or outwardly, as seen in FIG. 4. When the trigger is pressed rearwardly, the leaf spring members 103 and 104 flex rearwardly with the trigger and the natural resiliency or memory thereof urges the trigger forwardly to its normal, at rest position.

A pair of inverted, generally U-shaped bracket members 105 and 106 are formed integrally with the shroud on the inner surface of the top wall 102 thereof, and extend downwardly over the pivot pins 60 and 61 of the trigger, retaining them in the stirrups 91 and 92.

MODIFICATION

Figure 13:
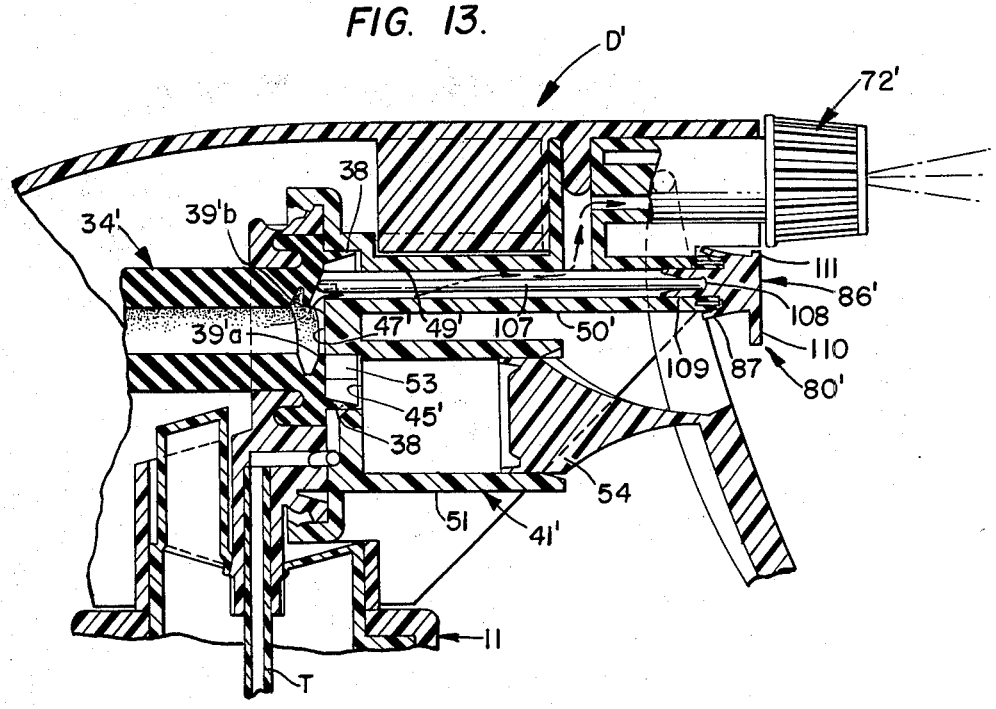
FIG. 13 is an enlarged fragmentary sectional view showing a modified discharge valve wherein positive opening of the valve from the bladder is provided and showing the discharge valve in the open position.
Figure 14:
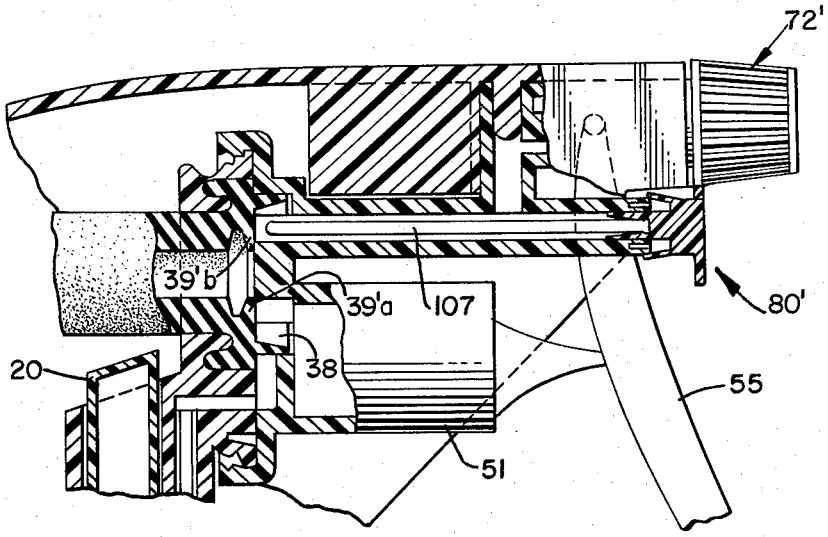
FIG. 14 is a view similar to FIG. 13, showing the valve in its closed position.
Figure 15:
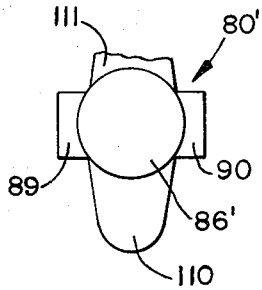
FIG. 15 is a front view of the modified trigger.

A modification of the dispensing device of the invention is indicated generally at D′ in FIGS. 13 through 15 and as with the previous form of the invention, includes a shroud 96 which is disposed in covering relationship to a modified manifold member 41′ having a first cylinder 51 defined thereon and in which a piston 54 is reciprocably received for operation by a trigger 55 to alternately draw material from a container, up through dip tube T, into the cylinder 51, past valve 38 defined on the bladder 34′, and thence past valve 39′*a* into the bladder for accumulation under pressure.

A slightly modified discharge tube 50′ has an elongate passage 49′ extended therethrough and positioned such that the valve ring 39′*b* normally closes the inner or rearward end of the passage 49′. An elongate valve actuator rod 107 extends through the passage 49′ from adjacent the valve 39′*b* to adjacent the outer or forward end of the passage 49′. The outer end 108 of rod 107 is snap-fitted, or otherwise suitably secured, to a shank portion 109 of a modified discharge valve member 80′ which comprises head 86′ having the shank or shaft 109 integral therewith. The head 86′ has a skirt 87 thereon as in the previous form of the invention and also has a pair of laterally outwardly projecting latching tabs 89 and 90. Additionally, the discharge valve member 80′ has a finger engaging structure or trigger configuration 110 formed integrally therewith to facilitate manipulation thereof with the finger of the user.

The dispensing device D′ is rendered tamper-proof by means of a thin frangible web 11 which integrally joins the head 86′ of discharge valve 80′ and the nozzle 72′ prior to use of the device. However, when the discharge valve 80′ is depressed to open the valve 39′*b*, as seen in FIG. 13, the web 111 is fractured, thus providing an indication that the device has been actuated.

The dispensing device D′ is shown prior to being actuated in FIG. 14 wherein the frangible web 111 is shown intact and the discharge valve 80′ in its forward biased condition with the valve 39′*b* closed, thereby precluding flow from the bladder 34′ and through the passage 49′ to the nozzle 72′.

Therefore, except for the modifications relative to the discharge tube 50′ and discharge valve 80′ and its association with the valve 39'b of bladder 34', this form of the invention is substantially the same as that previously described.

It should be noted that shank portion 109 of the modified discharge valve 80' effects a fluid tight seal with the outer end of passage 49'.

Thus, the present invention provides a unique dispensing device which is capable of operating in several different modes, including duration, relatively constant spray, and continuous spray during operation of an actuator.

With the unique structure of the present invention, substantially all of the components thereof may be snapped together for assembly of the device and a minimum number of parts, for example 10, may be used in its construction. Further, the device may be easily and economically molded. Therefore, a simple three plate molding operation with the maximum number of cavities may be used in making the present invention.

The unique discharge valve used with the dispensing device of the invention serves as an automatic off feature thereby adding to the safety of the dispensing device and rendering it suitable for use around small children. In other words, a child would be unlikely to manipulate both the trigger and the discharge valve in order to obtain discharge of the material from the device of the invention.

Assembly of the device of the invention is quite easy, and orientation of the bladder, for example, is not required to obtain proper valving action. The snap together, modular assembly of the device of the invention makes it easy to pre-test various subassemblies for determining the operation of various phases of the device. Further, these same features make it relatively easy to interchange different material for the bladder and other elements or components of the invention for desired purposes.

The materials used in the device may be selected for any desired effect and in this connection the bladder is not normally submerged in product during shipment or storage. Further, there are no metal parts used in the device of the invention with the possible exception of the actuator rod 107 which may be metal if desired.

The combination of orifice sizes, bladder wall thickness, blow-by pressure and the like permits a wide range of pressures to be used or obtained, suitable for dispensing a wide variety of products, and the device of the invention is easily adaptable to existing container configurations without regard to any specific structural requirements as to strength or adaptability to conventional containers.

In addition to all of the other advantages of the invention, it is less expensive than conventional spray systems and since the subassemblies may be made and assembled as noted above, high quality control can be obtained with a low reject rate.

Further, the unique, positive acting vent of the invention insures that proper venting of the container will be obtained. In operation of this vent, when the trigger is actuated to accumulate material in the bladder, the bladder expands and engages the post or vent actuator 20, to move the wall 18 downwardly and bring the opening 19 into registry with the fluted end portion 27 of stem 26, thus venting atmospheric air to the interior of the container. This positive vent, and the simplicity of construction and ability to use any desired materials, results in an economical, effective, and easy to use spray dispenser which does not rely upon chemical propellants, and yet which is capable of obtaining duration or continuous discharge of material.

As this invention may be embodied in several forms without departing from the spirit or essential characteristics thereof, the present embodiment is, therefore, illustrative and not restrictive, since the scope of the invention is defined by the appended claims rather than by the description preceeding them, and all changes fall within the metes and bounds of the claims or that form their functional as well as conjointly cooperative equivalents are, therefore, intended to be embraced by those claims.

We claim:

1. An economical, easy to use, duration and/or continuous action dispensing device, comprising: a manifold member having fastening means thereon for securing the manifold member to a container; first expansible chamber means carried by the manifold member and including actuator means operable to alternately draw material from a container and then pressurize it; second expansible chamber means carried by the manifold member for receiving pressurized material from the first expansible chamber means and accumulating, under pressure, a quantity of the material for subsequent, prolonged discharge; a stationary discharge nozzel connected to receive the pressurized material from the second expansible chamber means and discharge valve means connected with the second expansible chamber means, and having a first position for precluding flow from the second expansible chamber means, and a second position enabling flow from the second expansible chamber means to the nozzle for discharge as desired, said discharge valve means including selectively operable latching means for holding the discharge valve means in its second position during operation of the actuator means to obtain a continuous discharge, said dispensing device being attachable to existing, conventional containers.

2. A dispensing device as claim 1, wherein: the actuator means comprises a pivoted trigger; the discharge nozzle is carried by the manifold member; and a discharge passage is connected between the first expansible chamber means and the discharge nozzle, said discharge valve means connected to control flow through the discharge passage.

3. A dispensing device as claim 2, wherein: the discharge valve means is positioned adjacent the trigger for easy access thereto, said discharge valve means normally being biased to its first, closed position precluding flow, and being engageable with the finger of the user for movement to its second position enabling flow to the nozzle.

4. A dispensing device as in claim 3, wherein: the latching means is carried by the discharge valve means; and said second expansible chamber means accumulates an amount of material therein during operation of the trigger, whereby continuous discharge of the material is obtained while the trigger is being operated.

5. A dispensing device as in claim 1, wherein: the actuator means is a pivotal trigger; the second expansible chamber means comprises an elastomeric bladder; and the first expansible chamber means comprises a piston and cylinder, the piston being connected to the trigger for operation thereby.

6. A dispensing device as in claim 5, wherein: the discharge valve means is normally biased to its first, closed position.

7. A dispensing device as in claim 1, wherein: the manifold member has one end defining a valving chamber therein, and first and second tubular members projecting therefrom in parallel relationship with one another and each being in communication at one of their ends with the valving chamber, a piston reciprocable in said first tubular member and defining with said first tubular member the first expansible chamber means, said second tubular member defining a discharge passage; a third tubular member extending parallel to the first and second tubular members and communicating at one of its ends with the discharge passage; the discharge nozzle carried on the other end of the third tubular member; and said discharge valve means being diposed in said discharge passage to control flow from the valving chamber to the nozzle.

8. An economical, easy to use, duration and/or continuous action dispensing device, comprising; a manifold member having fastening means thereon for securing the manifold member to a container; piston and cylinder means carried by the manifold member; pivotable trigger means connected with the piston to operate the piston to alternately draw material from a container and then pressurize it; an elastomeric bladder carried by the manifold member for receiving pressurized material from the piston and cylinder means and accumulating, under pressure, a quantity of the material for subsequent, prolonged discharge; a stationary discharge nozzle carried by the manifold member; and discharge valve means connected with the elastomeric bladder, and having a first position for precluding flow from the elastomeric bladder, and a second position enabling flow from the elastomeric bladder to the nozzle for discharge as desired, said discharge valve means being normally biased to its first, closed position and movable to its second, open position to enable flow, the material drawn from the container and pressurized by the piston and cylinder means being accumulated in the elastomeric bladder when the discharge valve means is in its first position, whereby a prolonged, pressurized discharge of material is obtained when the discharge valve means is moved to its second position; the discharge valve means comprising an elongate discharge passage communicating between the elastomeric bladder and the nozzle, and an elongate tubular valve member reciprocable in the passage, said valve member having an open end for receiving material from the elastomeric bladder, and a plurality of radial ports arranged to be placed in communication with the nozzle when the discharge valve means is in its second position, and said valve member having an enlarged actuator head engageable with the finger of the user to reciprocate the valve member to the second position; said dispensing device being attachable to existing, conventional containers.

9. A dispensing device as in claim 8, wherein: radially outwardly projecting locking tabs are on the head for engagement behind the nozzle when the head is rotated, to lock the discharge valve member in its second, open position for continuous flow of material from the bladder.

10. An economical, easy to use, duration and/or continuous action dispensing device, comprising: a manifold member having fastening means thereon for securing the manifold member to a container; piston and cylinder means carried by the manifold member; pivotable trigger means connected with the piston to operate the piston to alternately draw material from a container and then pressurize it; and elastomeric bladder carried by the manifold member for receiving pressurized material from the piston and cylinder means and accumulating, under pressure, a quantity of the material for subsequent, prolonged discharge; a discharge nozzle carried by the manifold member; and discharge valve means connected with the expansible bladder and having a first position for precluding flow from the expansible bladder, and a second position enabling flow from the expansible bladder to the nozzle for discharge as desired, said discharge valve means being normally biased to its first, closed position and movable to its second, open position to enable flow, the material drawn from the container and pressurized by the piston and cylinder means being accumulated in the elastomeric bladder when the discharge valve means is in its first position, whereby a prolonged, pressurized discharge of material is obtained when the discharge valve means is moved to its second position, the discharge valve means comprising an elongate actuator rod reciprocable in a discharge passage extending between the elastomeric bladder and nozzle, said elastomeric bladder having an integrally formed outlet valve means in a position to be engaged by the actuator rod and moved to an open position when the rod is moved inwardly; said dispensing device being attachable to existing, conventional containers.

11. A dispensing device as in claim 10, wherein: a frangible web integrally joins the head and the nozzle prior to use of the dispensing device and functions as a tamper-proof means, actuation of the discharge valve member to cause discharge of material through the nozzle requiring breaking of the frangible web.

12. An economical, easy to use, duration and/or continuous action dispensing device, comprising: a manifold member having fastening means thereon for securing the manifold member to a container; first expansible chamber means carried by the manifold member and including first actuator means operable to alternately draw material from a container and then pressurize it; second expansible chamber means carried by the manifold member for receiving pressurized material from the first expansible chamber means and accumulating, under pressure, a quantity of the material for subsequent, prolonged discharge; and discharge valve means connected with the second expansible chamber means, and having a first position for precluding flow from the second expansible chamber means, and a second position enabling flow from the second expansible chamber means to a nozzle for discharge as desired, said manifold member having one end defining a valving chamber therein, and first and second tubular members projecting therefrom in parallel relationship with one another and each being in communication at one of their ends with the valving chamber, a piston reciprocable in said first tubular member and defining with said first tubular member the first expansible chamber means, said second tubular member defining a discharge passage; a third tubular member extending parallel to the first and second tubular members and communicating at one of its ends with the discharge passage; said second expansible chamber means comprising an elastomeric bladder carried by said one end of the manifold member and having an integral, cylindrical valving wall projecting from one end thereof into the valving chamber; an inlet port opening into the valving chamber through one side thereof, said valving wall normally closing said inlet port and being movable to expose the inlet port upon operation of said piston to enlarge said first expansible chamber means, whereby flow is enabled through the inlet port into the valving chamber and first expansible chamber means, said valving wall being moved into closing relationship relative to said inlet port when the piston is moved to decrease the size of the first expansible chamber means; said bladder having a hollow interior in communication with said valving chamber, whereby material entering said valving chamber also enters said bladder area; a discharge nozzle carried on the other end of the third tulular member; and said discharge valve means being disposed in said discharge passage to control flow from the valving chamber to the nozzle.

13. A dispensing device as in claim 12, wherein: a bladder retainer is connected with said one end of the manifold member and has means thereon engaging the bladder and holding it to the manifold member, said bladder retainer having said fastening means thereon for securing the dispensing device to a container; and positive acting vent means carried by the bladder retainer and fastening means in a position to be engaged by the bladder when the bladder is expanded upon introduction of material thereinto for positive opening movement of the vent means.

14. A dispensing device as claim 13, wherein: the bladder retainer has a circular end portion with a central opening therethrough; the fastening means comprises a threaded closure ring having a central opening and rotatably carried by said circular end of the bladder retainer; and the vent means comprises a cylindrical wall extended through the central openings in the bladder retainer and closure ring and having friction means on an outer surface thereof cooperating with inner surfaces of the central opening through the bladder retainer, to hold the bladder retainer, closure ring and vent means in assembled relationship, said vent means including an end wall normally closing the opening through said circular end portion of the bladder retainer, and said end wall having a vent actuator thereon engageable by the bladder when the bladder is expanded, to open the vent.

15. An economical, easy to use, duration and/or continuous action dispensing device, comprising: a manifold member having fastening means thereon for securing the manifold member to a container; first expansible chamber means carried by the manifold member and including first actuator means operable to alternately draw material from a container and then pressurize it; second expansible chamber means carried by the manifold member for receiving pressurized material from the first expansible chamber means and accumulating, under pressure, a quantity of the material for subsequent, prolonged discharge; discharge valve means connected with the second expansible chamber means, and having a first position for precluding flow from the second expansible chamber means, and a second position enabling flow from the second expansible chamber means to a nozzle for discharge as desired; and vent means associated with the fastening means to vent the container and prevent collapse thereof as product is removed therefrom, said vent means comprising an annular wall having a central opening therethrough, a stem extending through said central opening and having channel means in an outer surface thereof, said annular wall normally being positioned with the central opening spaced from the channel means and engaged with the stem and closed thereby, and being movable to locate said central opening in registry with said channel means to vent the container when product is removed from the container; said dispensing device being attachable to existing; conventional containers.

16. A dispensing device as in claim 15, wherein: the second expansible chamber means comprises an expansible bladder; and the vent means includes a vent actuator extending from the annular wall to adjacent the bladder, whereby when the bladder is expanded, the vent actuator is engaged thereby and moves the annular wall to open the vent.

17. In a trigger operated dispenser, including a body having expansible chamber means therein connected in fluid communication between a container for material to be dispensed and a nozzle for discharge of the material, and a pivoted trigger pivotally connected at one end to the body and connected with the expansible chamber means and having first and second positions, respectively, to operate the expansible chamber means to draw material from the container and discharge it under pressure through the nozzle, the improvement comprising; a one-piece, molded shroud secured over the body in at least partially enclosing relationship thereto, and having trigger return spring means integrally molded therewith in a position to engage the trigger and bias it to one of said positions, the trigger being engageable with the fingers of the user to move it to its other position against the bias of the spring means, said integrally molded spring means resulting in an economical, easy to assembly dispenser.

18. In a trigger operated dispenser as in claim 17, wherein: said one end of the trigger is bifurcated and has a pair of elongate, spaced apart legs; and the shroud includes a top wall and spaced apart, depending side walls, said spring means comprising a pair of depending, resiliently yieldable spring arms disposed in contacting alignment with said spaced apart legs of the trigger.

19. In a trigger operated dispenser as in claim 18, wherein: the body has recess means therein on opposite sides thereof; the trigger has inturned pivot pins on the ends of the spaced apart legs, said pins received in said recess means; and said shroud has depending, integrally molded projections on an inside surface portion of the top wall thereof, engaged with said pins, holding them in said recessed means.

20. In a trigger operated dispenser as in claim 19, wherein: the shroud and body have integrally formed, complementary projection and recess means defining self-aligning structure for insuring proper alignment of the shroud relative to the body when they are assembled together.

* * * * *